US012404799B1

(12) United States Patent
Bruss et al.

(10) Patent No.: US 12,404,799 B1
(45) Date of Patent: Sep. 2, 2025

(54) COOLING SYSTEM FOR A WORK VEHICLE

(71) Applicant: DEERE & COMPANY, Moline, IL (US)

(72) Inventors: Paul T. Bruss, Waterloo, IA (US); Kaushik Halder, Kharagpur (IN)

(73) Assignee: DEERE & COMPANY, Moline, IL (US)

( * ) Notice: Subject to any disclaimer, the term of this patent is extended or adjusted under 35 U.S.C. 154(b) by 0 days.

(21) Appl. No.: 18/799,361

(22) Filed: Aug. 9, 2024

(51) Int. Cl.
*F01P 5/04* (2006.01)
*F04D 27/00* (2006.01)
*F04D 29/36* (2006.01)

(52) U.S. Cl.
CPC ..... *F01P 5/043* (2013.01); *F04D 29/362* (2013.01); *F04D 27/002* (2013.01); *F04D 27/004* (2013.01)

(58) Field of Classification Search
CPC ..... F01P 5/043; F01P 5/02; F01P 7/02; F01P 7/06; F01P 7/12; F01P 1/00; F01P 2001/005; F04D 27/002; F04D 27/004; F04D 29/362; F04D 29/5806
See application file for complete search history.

(56) References Cited

U.S. PATENT DOCUMENTS

| | | | | |
|---|---|---|---|---|
| 6,439,850 | B1 * | 8/2002 | McCallum | F04D 29/063 416/144 |
| 7,937,938 | B2 | 5/2011 | Kuipers et al. | |
| 8,162,086 | B2 | 4/2012 | Robinson | |
| 8,997,906 | B2 | 4/2015 | Schertz et al. | |
| 9,033,080 | B2 | 5/2015 | Schertz et al. | |
| 9,133,756 | B2 | 9/2015 | Soldan et al. | |
| 9,500,117 | B2 * | 11/2016 | Sullivan | F01P 11/12 |
| 9,586,473 | B2 | 3/2017 | Pfohl et al. | |
| 9,599,009 | B2 | 3/2017 | Smemo et al. | |
| 9,605,583 | B2 | 3/2017 | Goering et al. | |
| 9,622,408 | B1 | 4/2017 | Miller et al. | |
| 10,372,575 | B1 | 8/2019 | North et al. | |
| 10,499,540 | B2 | 12/2019 | North et al. | |
| 11,073,074 | B1 | 7/2021 | Kennedy et al. | |
| 11,162,507 | B2 | 11/2021 | Miller | |
| 11,668,228 | B2 | 6/2023 | Muttepawar et al. | |
| 11,698,122 | B2 | 7/2023 | Lubben | |
| 2013/0153180 | A1 | 6/2013 | Montocchio et al. | |
| 2016/0102597 | A1 | 4/2016 | Jurzok et al. | |
| 2020/0401165 | A1 * | 12/2020 | Rollins | F04D 27/004 |

FOREIGN PATENT DOCUMENTS

| | | | |
|---|---|---|---|
| EP | 2604460 | B1 | 4/2016 |

* cited by examiner

*Primary Examiner* — Grant Moubry
*Assistant Examiner* — James G Moubry

(57) ABSTRACT

A cooling system for a work vehicle includes a fan rotating in a first direction to generate an air flow in a first direction, a speed sensor sensing a speed of the fan, one or more sensors sensing a load of a power source, a temperature sensor sensing an ambient temperature, and a controller configured to determine the load of the power source, determine the speed of the fan, determine an estimated speed of the fan based in part on the load of the power source and the ambient temperature, determine a speed difference of the speed of the fan and the estimated speed of the fan, and determine changing the air flow to a second direction based in part on the speed difference and the load of the power source.

20 Claims, 4 Drawing Sheets

COOLING SYSTEM FOR A WORK VEHICLE

FIELD OF THE DISCLOSURE

The present disclosure relates to a cooling system of a work vehicle.

BACKGROUND

Work vehicles can include cooling fans for circulating air over a radiator during normal operation of the machine. The cooling fan and radiator can be housed in an engine compartment that includes openings for air to flow through the compartment. Typically, these openings are covered with a grill or screen to limit debris from entering the engine compartment.

SUMMARY

According to an aspect of the present disclosure, a cooling system for a work vehicle includes a fan rotating in a first direction to generate an air flow in a first direction, a speed sensor sensing a speed of the fan, one or more sensors sensing a load of a power source, a temperature sensor sensing an ambient temperature, and a controller configured to determine the load of the power source, determine the speed of the fan, determine an estimated speed of the fan based in part on the load of the power source and the ambient temperature, determine a speed difference of the speed of the fan and the estimated speed of the fan, and determine changing the air flow to a second direction based in part on the speed difference and the load of the power source.

According to an aspect of the present disclosure, the controller is configured to change the air flow to the second direction for a period of time.

According to an aspect of the present disclosure, the controller is configured to change the air flow back to the first direction after the period of time.

According to an aspect of the present disclosure, the controller determines the period of time based in part on the speed difference and the load of the power source.

According to an aspect of the present disclosure, the period of time is a first preselected amount of time.

According to an aspect of the present disclosure, the controller is configured to provide notification when the number of changes in the air flow for a second preselected amount of time reaches or exceeds a rate threshold.

According to an aspect of the present disclosure, the controller is configured to change the air flow to the second direction when the load of the power source is at or below a load threshold and the speed difference is at or above a speed threshold.

According to an aspect of the present disclosure, the controller is configured to change the air flow to the second direction by reversing the rotation of the fan.

According to an aspect of the present disclosure, the controller is configured to change the air flow to the second direction by adjusting a pitch of a fan blade of the fan.

According to an aspect of the present disclosure, the controller is configured to provide notification when the speed difference is at or above a threshold.

The above and other features will become apparent from the following detailed description and accompanying drawings.

BRIEF DESCRIPTION OF THE DRAWINGS

The detailed description refers to the accompanying figures.

Like reference numerals are used to indicate like elements throughout the several figures.

DETAILED DESCRIPTION

The embodiments or implementations disclosed in the above drawings and the following detailed description are not intended to be exhaustive or to limit the present disclosure to these embodiments or implementations.

Figure 1:
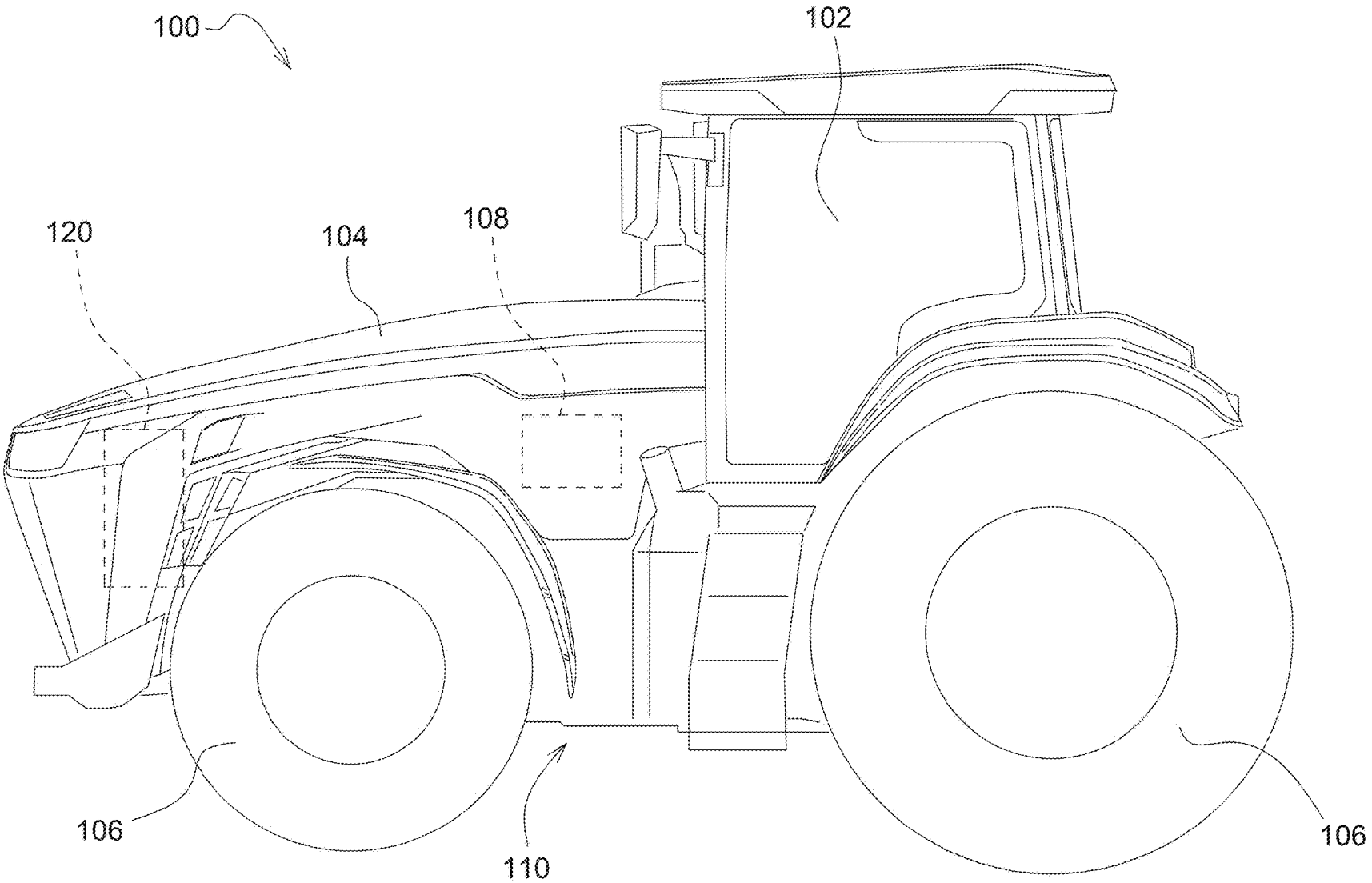
FIG. 1 is a perspective view of a work vehicle including a cooling system, according to an implementation.

With reference to FIG. 1, a work vehicle 100, for example an agricultural tractor, can include an operator station or cab 102, a hood 104, one or more ground engaging apparatus 106, for example wheels or track assemblies, and a frame or chassis 110. The work vehicle 100 can include one or more power sources 108, for example an internal combustion engine, a hybrid engine, and a battery and an electric machine. The work vehicle 100 can include an operator interface having any number and combination of electronic devices, such as an interactive display. The work vehicle 100 can have a rigid or an articulated frame 110. The work vehicle 100 can include a cooling system 120 for removing heat from various components and systems during operation. This disclosure also applies to other types of work vehicles in agriculture, construction, forestry, and road building.

Figure 2:
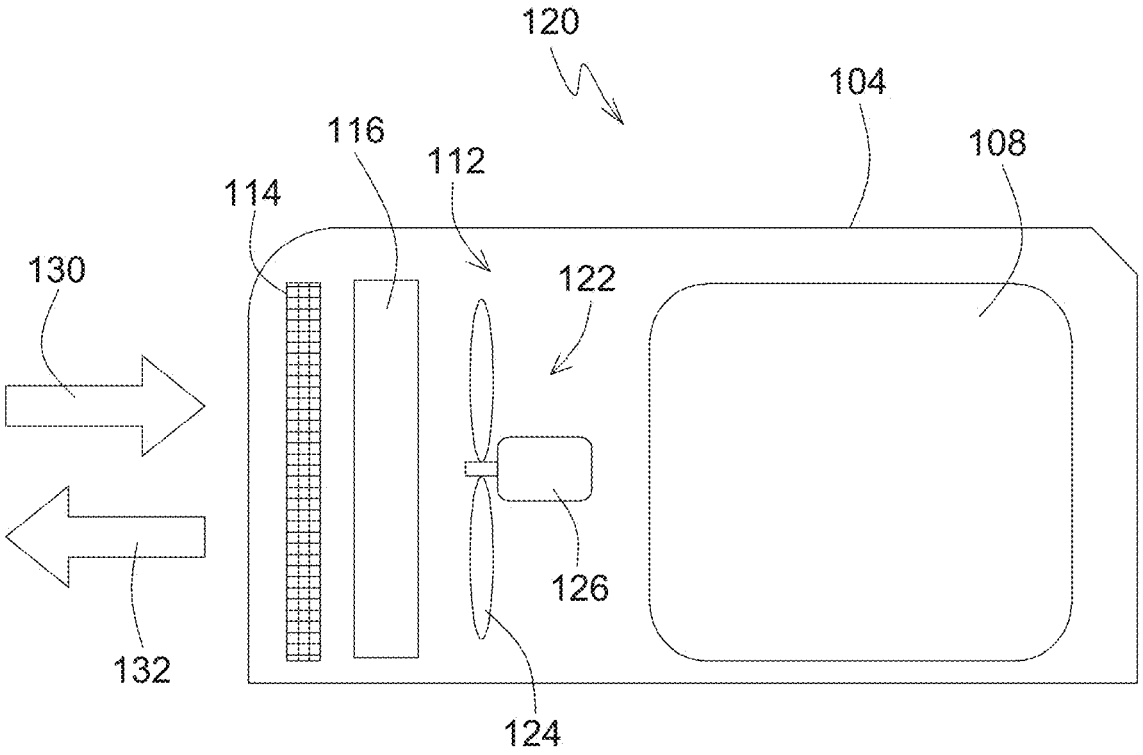
FIG. 2 is a schematic diagram of a cooling system for a work vehicle, according to an implementation.

With reference to FIG. 2, a cooling system 120 for a work vehicle 100 can include a fan 122 positioned within a compartment 112 at least partially defined by the hood 104. The fan 122 can be positioned near a grill or screen 114 and a cooling element 116, for example a radiator. The fan 122 includes one or more fan blades 124 and a fan motor 126. The fan 122 can rotate in a first direction creating an air flow in a first direction 130 from the screen 114 towards the cooling element 116. The fan 122 can rotate in a second direction creating an air flow in a second direction 132, which is opposite of the first direction, from the cooling element 116 towards the screen 114. Alternatively, or additionally, the fan 122 can rotate in one direction and the pitch or angle of the fan blades 124 can be changed to the reverse the direction of the air flow between the first direction 130 and the second direction 132.

When the fan 122 is rotating in the first direction, material can collect on the screen 114, which can reduce the cooling capacity of the cooling system. Reversing the direction of the air flow produced by the fan 122 can remove the material from the screen 114. When the fan 122 is operating in the second direction 132, the fan 122 can create additional noise and the cooling capacity of the cooling system 120 can be reduced. According to some implementations, the cooling system 120 can reduce or minimize the number of times the direction of the air flow is changed or reversed by determining when a reversal of the air flow is needed.

Figure 3:
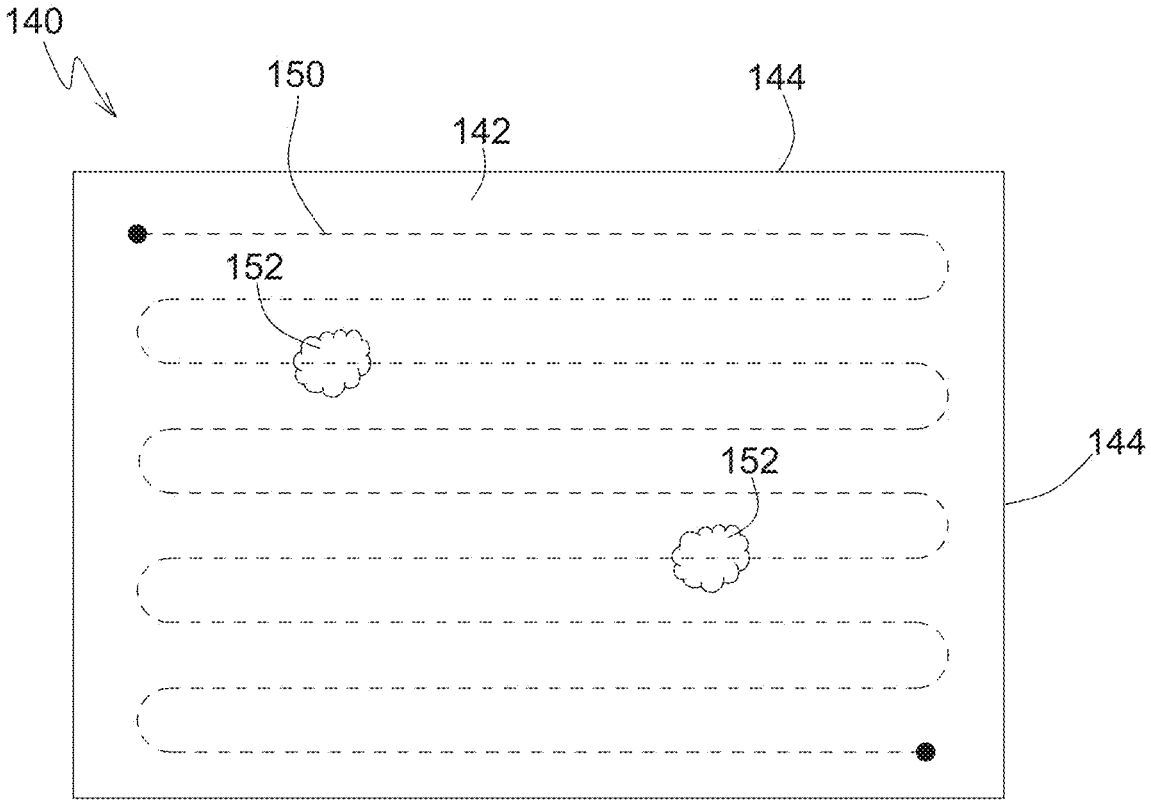
FIG. 3 is a map of a field, according to an implementation.
Figure 4:
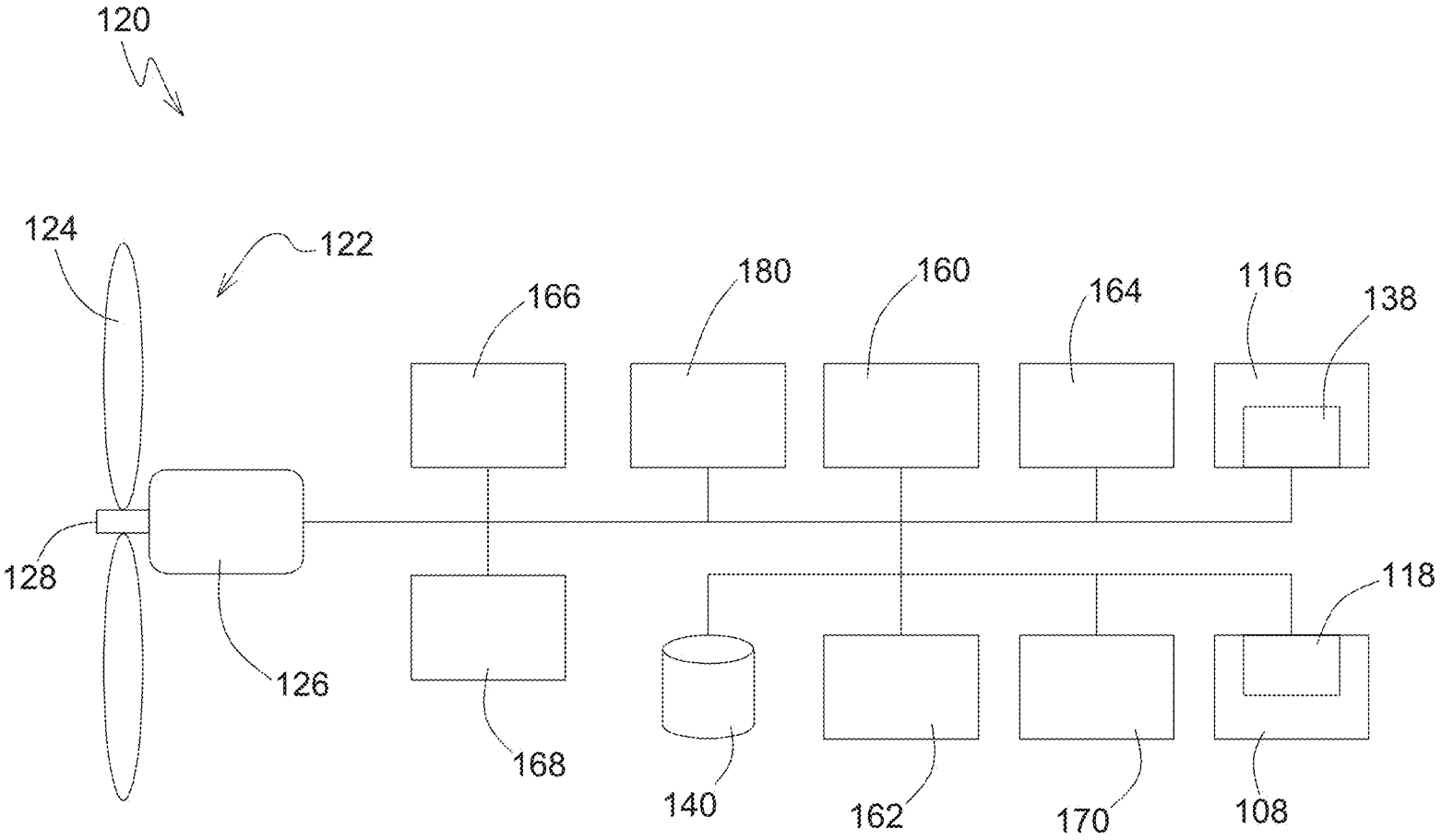
FIG. 4 is a schematic diagram of a cooling system for a work vehicle, according to an implementation.

With reference to FIG. 3, an electronic map 140 of a field 142 includes a field boundary 144 around the perimeter of the field. The map 140 can include a proposed or actual route 150 for a work vehicle 100 to travel through the field 142 and perform one or more operations, for example planting, tilling, spraying, mowing, harvesting, etc. The map 140 can include one or more areas 152 of an anticipated or predicted higher load on the power source 108 (e.g., sloped or uphill terrain, low-traction soil conditions, etc.).

With reference to FIGS. 1-4, an electronic control unit or controller 160 can connect to and communicate with the electronic map 140, which can be stored locally or remotely, a Global Positioning System (GPS) receiver 162, a speed sensor 128 detecting or measuring the rotational speed of the fan 122, a temperature sensor 164 detecting or measuring an ambient temperature, a temperature sensor 138 detecting or measuring a temperature of a coolant in the cooling element 116, and one or more sensors 170 detecting or measuring various operations of the work vehicle 100 (e.g., engine sensors, transmission sensors, hydraulic sensors, electrical sensors, speed sensors, pressure sensors, temperature sensors, torque sensors, fuel flow sensors, air flow sensors, etc.). The controller 160 can connect to and communicate with a pneumatic or hydraulic system 166 or an electrical system 168 of the work vehicle 100 to change or reverse the direction of the air flow of the fan 122. For example, the controller 160 can connect to and communicate with a valve or actuator of the pneumatic or hydraulic system 166 to set the rotational speed and direction of the fan 122 and to change or reverse the rotational direction of the fan 122 or change the pitch or angle of the fan blades 124. Alternatively, or additionally, the controller 160 can connect to and communicate with a switch, relay, actuator, or controller of the electrical system 168 to set the rotational speed and direction of the fan 122 and to change or reverse the rotational direction of the fan 122 or change the pitch or angle of the fan blades 124.

The controller 160 can determine the load of the power source 108. The controller 160 can communicate with a power source controller 118 (e.g., engine controller, battery management system, etc.) to determine the load of the power source 108. The controller 160 can communicate with the one or more sensors 170 (e.g., air flow sensor, fuel flow sensor, engine speed sensor, etc.) to determine the load of the power source 108. The controller 160 can determine whether the load of the power source 108 is at a high or low load or anywhere in between. The controller 160 can determine whether the load of the power source 108 is below, at, or above a load threshold, which can be a percentage of a maximum load of the power source 108. The load threshold can be preset, preselected, or determined via the controller 160.

The controller 160 can determine the actual speed of the fan 122 based on the set rotational speed of the fan 122 or detecting or measuring the speed of the fan 122 via a speed sensor 128. The controller 160 can determine an estimated speed of the fan 122 based on one or more of the load of the power source 108, the ambient temperature detected or measured via the temperature sensor 164, and the coolant temperature detected or measured via the temperature sensor 138. The estimated speed of the fan 122 increases as the load of the power source 108 increases. The estimated speed of the fan 122 increases as the ambient temperature increases. The estimated speed of the fan 122 increases as the coolant temperature increases. The load of the power source 108, the ambient temperature, and the coolant temperature can influence the estimated speed of the fan 122 to the same or a different extent. For example, the load of the power source 108 can have more of an effect on the estimated speed of the fan 122 than the ambient temperature or the coolant temperature, the ambient temperature can have more of an effect on the estimated speed of the fan 122 than the load of the power source 108 or the coolant temperature, or the coolant temperature can have more of an effect on the estimated speed of the fan 122 than the load of the power source 108 or the ambient temperature. The controller 160 can determine a speed difference between the actual speed of the fan 122 and the estimated speed of the fan 122. The controller 160 can determine whether the speed difference is below, at, or above a speed threshold, which can be a percentage of the estimated speed or actual speed of the fan 122. The speed threshold can be preset, preselected, or determined via the controller 160.

The controller 160 can determine whether to change or reverse the air flow from a first direction 130 to a second direction 132 based in part on the speed difference, the load of the power source 108, or both. The controller 160 can determine to change or reverse the air flow from the first direction 130 to the second direction 132 when the speed difference is at or above the speed threshold and the load of the power source 108 is at or below the load threshold. The controller 160 can change the air flow to the second direction 132 for a period of time. The controller 160 can change the air flow back to the first direction 130 after the period of time. The period of time can be preset or preselected. Alternatively, or additionally, the controller 160 can determine the period of time based in part on one or more of the speed difference, the load of the power source 108, the ambient temperature, and the coolant temperature. For an example, a larger the speed difference can result in a longer the period of time. For another example, the period of time can continue until the speed difference reduces to or below the speed threshold, the load of the power source 108 increases to or above the load threshold, or both. The controller 160 can change the air flow to the second direction 132 by reversing the rotation of the fan 122. Alternatively, or additionally, the controller 160 can change the air flow to the second direction 132 by adjusting a pitch of the fan blade 124.

The controller 160 can determine the number of changes or reversals of the air flow in a preset or preselected amount of time. The controller 160 can provide an audio or visual notification, or both, via a local, remote, or mobile electronic device 180 (e.g., vehicle display, remote computer, cell phone, etc.) when the number of changes or reversals of the air flow in the preselected amount of time reaches or exceeds a rate threshold, which can be preset, preselected, or determined via the controller 160. The controller 160 can provide an audio or visual notification via the electronic device 180 when the speed difference is below, at, or above the speed threshold. The controller 160 can provide an audio or visual notification via the electronic device 180 when the load of the power source 108 is below, at, or above the load threshold. The controller 160 can provide an audio or visual notification via the electronic device 180 when the number of changes or reversals of the air flow in the preselected amount of time reaches or exceeds the rate threshold.

Figure 5:
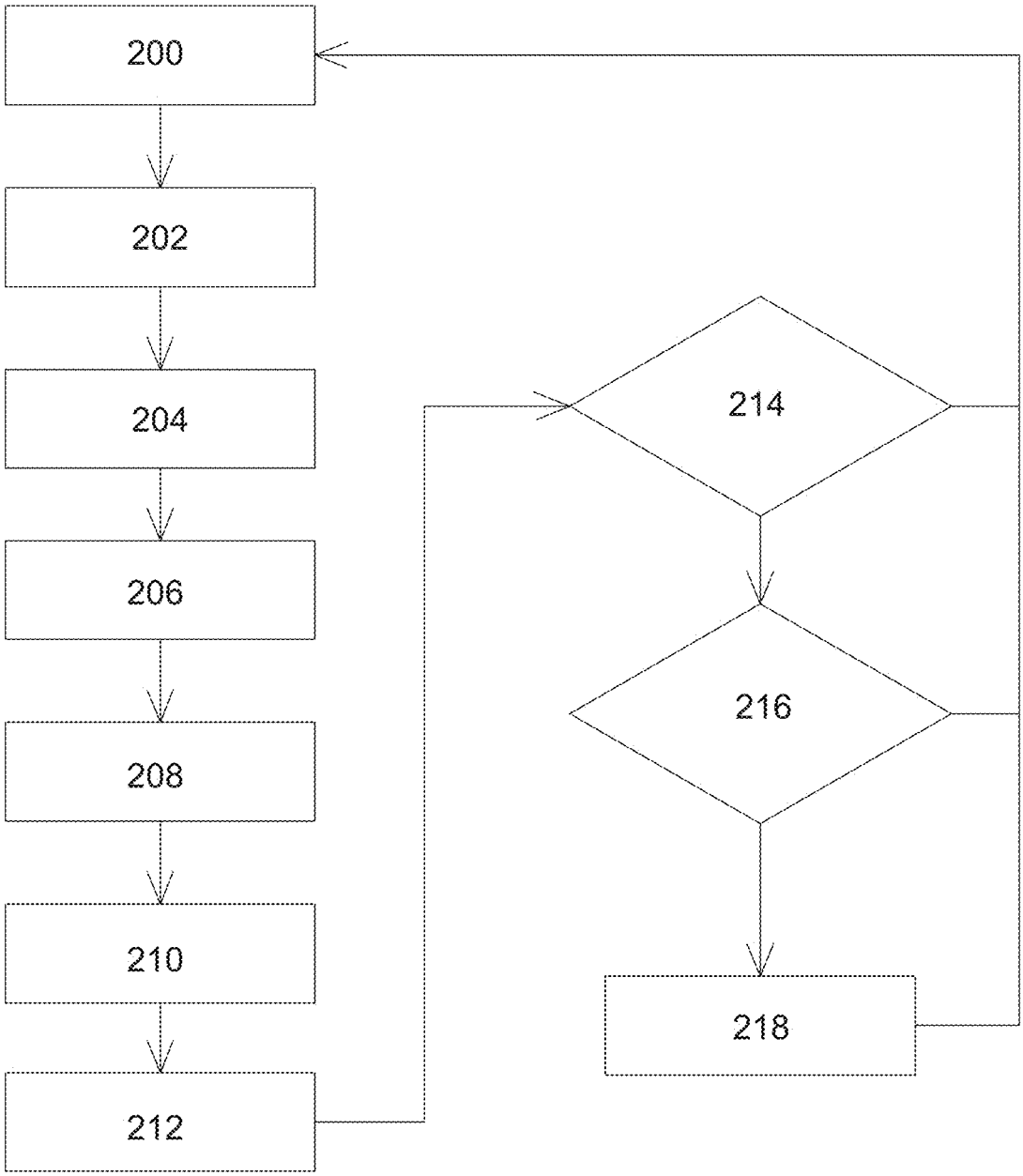
FIG. 5 is a flow diagram of a cooling system for a work vehicle, according to an implementation.

With reference to FIG. 5, a cooling system 120 for a work vehicle 100 includes one or more of the following steps, processes, or operations. At 200, the controller 160 monitors the cooling system 120. At 202, the controller 160 determines the ambient temperature via the temperature sensor 164. At 204, the controller 160 determines the coolant temperature via the temperature sensor 138. At 206, the controller 160 determines the load of the power source 108 via the power source controller 118, the one or more sensors 170, or both. At 208, the controller 160 determines the actual fan speed by the set rotational speed of the fan 122, the speed sensor 128, or both. At 210, the controller 160 determines the estimated fan speed via the load of the power source 108, the ambient temperature, and the coolant temperature.

At 212, the controller 160 determines the speed difference between the actual fan speed and the estimated fan speed. At 214, the controller 160 determines whether the load of the power source is at or below a load threshold. At 216, the controller 160 determines whether the speed difference is at or above a speed threshold. If either 214 or 216 are false, then the controller 160 continues monitoring the cooling system 120 at 200. If both 214 and 216 are true, then at 218 the controller 160 changes the air flow from a first direction 130 to a second direction 132 for a period of time, and then changes the air flow back to the first direction 130. The controller 160 then continues monitoring the cooling system 120 at 200. In other implementations, one or more of these steps, processes, or operations may be omitted, repeated, re-ordered, combined, or separated and are within the scope of the present disclosure.

The electronic control unit(s) or controller(s) disclosed herein can have one or more microprocessor-based electronic control units or controllers, which perform calculations and comparisons and execute instructions, for example algorithms. The controller includes a processor, a core, volatile and non-volatile memory, digital and analog inputs, and digital and analog outputs. The controller can include non-transitory, computer readable memory, such as random-access memory (RAM), read only memory (ROM), or electrically erasable programmable read only memory (EEPROM), which include instructions for execution by the processor, for example algorithms. The controller connects to and communicates with various input and output devices including, but not limited to, switches, relays, solenoids, actuators, light emitting diodes (LED's), passive and interactive displays, radio frequency devices (RFD's), sensors, and other controllers. The controller receives communications or signals, via electrically or any suitable electromagnetic communication, from one or more devices, determines an appropriate response or action, and sends communications or signals to one or more devices. The controller can be a microprocessor, an application specific integrated circuit (ASIC), a digital processor, or a programmable logic controller, also known as a PLC or programmable controller. The controller can connect to and communicate with an electronic control system of the work vehicle through a data bus, such as a CAN bus, or the controller can be a part the electronic control system of the work vehicle.

The terminology used herein is for the purpose of describing example embodiments or implementations and is not intended to be limiting of the disclosure. As used herein, the singular forms "a," "an," and "the" are intended to include the plural forms as well, unless the context clearly indicates otherwise. It will be further understood that the any use of the terms "has," "includes," "comprises," or the like, in this specification, identifies the presence of stated features, integers, steps, operations, elements, and/or components, but does not preclude the presence or addition of one or more other features, integers, steps, operations, elements, components, and/or groups thereof.

Those having ordinary skill in the art will recognize that terms such as "above," "below," "upward," "downward," "top," "bottom," etc., are used descriptively for the figures, and do not represent limitations on the scope of the present disclosure, as defined by the appended claims. Furthermore, the teachings may be described herein in terms of functional and/or logical block components or various processing steps, which may include any number of hardware, software, and/or firmware components configured to perform the specified functions.

Terms of degree, such as "generally," "substantially," or "approximately" are understood by those having ordinary skill in the art to refer to reasonable ranges outside of a given value or orientation, for example, general tolerances or positional relationships associated with manufacturing, assembly, and use of the described embodiments or implementations.

As used herein, "e.g.," is utilized to non-exhaustively list examples and carries the same meaning as alternative illustrative phrases such as "including," "including, but not limited to," and "including without limitation." Unless otherwise limited or modified, lists with elements that are separated by conjunctive terms (e.g., "and") and that are also preceded by the phrase "one or more of" or "at least one of" indicate configurations or arrangements that potentially include individual elements of the list, or any combination thereof. For example, "at least one of A, B, and C" or "one or more of A, B, and C" indicates the possibilities of only A, only B, only C, or any combination of two or more of A, B, and C (e.g., A and B; B and C; A and C; or A, B, and C).

While the above describes example embodiments or implementations of the present disclosure, these descriptions should not be viewed in a restrictive or limiting sense. Rather, there are several variations and modifications which may be made without departing from the scope of the appended claims.

What is claimed is:

1. A cooling system for a work vehicle, comprising:

a fan rotating in a first direction to generate an air flow in a first direction;

a speed sensor sensing a speed of the fan;

one or more sensors sensing a load of a power source;

a temperature sensor sensing an ambient temperature; and a controller configured to determine the load of the power source, determine the speed of the fan, determine an estimated speed of the fan based in part on the load of the power source and the ambient temperature, determine a speed difference of the speed of the fan and the estimated speed of the fan, and determine changing the air flow to a second direction based in part on the speed difference and the load of the power source.

2. The cooling system of claim 1, wherein the controller is configured to change the air flow to the second direction for a period of time.

3. The cooling system of claim 2, wherein the controller is configured to change the air flow back to the first direction after the period of time.

4. The cooling system of claim 2, wherein the controller determines the period of time based in part on the speed difference and the load of the power source.

5. The cooling system of claim 2, wherein the period of time is a first preselected amount of time.

6. The cooling system of claim 3, wherein the controller is configured to provide notification when a number of changes in the air flow for a second preselected amount of time reaches or exceeds a rate threshold.

7. The cooling system of claim 1, wherein the controller is configured to change the air flow to the second direction when the load of the power source is at or below a load threshold and the speed difference is at or above a speed threshold.

8. The cooling system of claim 1, wherein the controller is configured to change the air flow to the second direction by reversing the rotation of the fan.

9. The cooling system of claim 1, wherein the controller is configured to change the air flow to the second direction by adjusting a pitch of a fan blade of the fan.

10. The cooling system of claim 1, wherein the controller is configured to provide notification when the speed difference is at or above a threshold.

11. A work vehicle, comprising:

one or more ground engaging apparatus;

a power source;

a fan rotating in a first direction to generate an air flow in a first direction;

a speed sensor sensing a speed of the fan;

one or more sensors sensing a load of a power source;

a temperature sensor sensing an ambient temperature; and a controller configured to determine the load of the power source, determine the speed of the fan, determine an estimated speed of the fan based in part on the load of the power source and the ambient temperature, determine a speed difference of the speed of the fan and the estimated speed of the fan, and determine changing the air flow to a second direction based in part on the speed difference and the load of the power source.

12. The work vehicle of claim 11, wherein the controller is configured to change the air flow to the second direction for a period of time.

13. The work vehicle of claim 12, wherein the controller is configured to change the air flow back to the first direction after the period of time.

14. The work vehicle of claim 12, wherein the controller determines the period of time based in part on the speed difference and the load of the power source.

15. The work vehicle of claim 12, wherein the period of time is a first preselected amount of time.

16. The work vehicle of claim 13, wherein the controller is configured to provide notification when a number of changes in the air flow for a second preselected amount of time reaches or exceeds a rate threshold.

17. The work vehicle of claim 11, wherein the controller is configured to change the air flow to the second direction when the load of the power source is at or below a load threshold and the speed difference is at or above a speed threshold.

18. The work vehicle of claim 11, wherein the controller is configured to change the air flow to the second direction by reversing the rotation of the fan.

19. The work vehicle of claim 11, wherein the controller is configured to change the air flow to the second direction by adjusting a pitch of a fan blade of the fan.

20. The work vehicle of claim 11, wherein the controller is configured to provide notification when the speed difference is at or above a threshold.

* * * * *